US009245513B1

(12) United States Patent
Dimitrov

(10) Patent No.: US 9,245,513 B1
(45) Date of Patent: Jan. 26, 2016

(54) RADIAL INPUT WAVEGUIDE

(71) Applicant: Dimitar Kirilov Dimitrov, Sofia (BG)

(72) Inventor: Dimitar Kirilov Dimitrov, Sofia (BG)

( * ) Notice: Subject to any disclaimer, the term of this patent is extended or adjusted under 35 U.S.C. 154(b) by 0 days.

(21) Appl. No.: 14/522,660

(22) Filed: Oct. 24, 2014

(51) Int. Cl.
*G10K 13/00* (2006.01)
*G10K 11/02* (2006.01)

(52) U.S. Cl.
CPC ..... *G10K 11/025* (2013.01)

(58) Field of Classification Search
CPC ..... G10K 13/00
USPC ..... 181/192
See application file for complete search history.

(56) References Cited

U.S. PATENT DOCUMENTS 3,972,385 A * 8/1976 Hino et al. ..... 181/192
5,163,167 A * 11/1992 Heil ..... 181/152
5,206,465 A * 4/1993 Jung ..... 181/152
7,743,878 B1 * 6/2010 Moore ..... 181/152
8,036,403 B2 * 10/2011 Xi ..... 381/160
8,469,140 B1 * 6/2013 Graber ..... 181/192
8,831,270 B1 * 9/2014 Dimitrov ..... 381/401
2008/0264717 A1 * 10/2008 Onishi ..... 181/192
2009/0057052 A1 * 3/2009 Delgado, Jr. ..... 181/192

* cited by examiner

*Primary Examiner* — Forrest M Phillips

(57) ABSTRACT

Radial input waveguide is provided having three consecutive sound wave propagation passageways, virtually divided by two folding regions along its extension from radial input up to substantially rectangular output, each one forming a different type of waves and all three channels shaped between an internal body and a shell housing enclosing it at a distance. The radially expanding initial air channel forms a cylindrical wave front between two input walls. A relatively wide region with parallel walls is available for wave folding at adaptably changeable diameters in this region with a small distance between the folded walls. All individual partial wave fronts on the periphery of the first folding region are traveling along substantially equal, accumulated from the last two air channels, path lengths, to the waveguide output, forming there a common isophase and planar wave front. The middle passageway contains all the physical dimensions necessary to control the waveguide performance, the most important being the height H and the width D, whose ratio controls the wave front output curvature.

18 Claims, 14 Drawing Sheets

RADIAL INPUT WAVEGUIDE

BACKGROUND

Waveguides are commonly referred to as "acoustical transformers" transforming the acoustical impedance from a horn input to the compression driver output. The current invention is to be implemented in line array systems as a transition element between the compression driver output and the high frequency line-array input, usually a rectangular vertical area band, very narrow in a horizontal plane, which makes possible fast horn flares opening, thus defining a relatively wide horizontal coverage. The vertical directivity of a line array system is typically realized by aligning such horns as close as possible to each other in a vertical line or in a slightly curved line, in both cases trying to simulate a cylindrical or prolate spheroidal wave front of the line array group up to the highest audible frequencies. To achieve this, all individual wave front outputs must be in-phase, all the way from top to bottom along its height, in order to create a coherent common wave front, without the typical for the conical horn groups vertical lobbing. Prior art teaches us how to do this in several ways.

In U.S. Pat. No. 5,163,167/Nov. 10, 1992, Heil teaches us how to build "Sound Wave Guide", shown in FIG. 1—"Prior Art", comprising a conduit which expands from its input to its output. The area of the output orifice of the wave guide is planar and oblong, and its conduit comprises a passage between the input orifice and the output area, adapted to guide the waves along a general direction from which the shortest paths allowed in the one or more passages are all of lengths which are practically identical from the input orifice to the output orifice of the conduit. This "Sound Wave Guide" is well-accepted and is in production by L-Acoustic Company, used in so-called V-DOSC Systems. One of the disadvantages in this prior art example is that expanding in axial direction in front of the driver, the length of the waveguide becomes relatively large. Another, probably worse, disadvantage is that this axial expansion actually widens the air-passages along the way towards the middle of the guide, where the wave front is forced to change direction to the rectangular output. With larger wall to wall distances at these foldings, inevitable phase interferences take part at higher frequencies, having quarter of the wavelengths comparable with these distances.

Adamson, in U.S. Pat. No. 6,581,719 B2/Jun. 24, 2003 teaches us how to use a "Wave Shaping Sound Chamber" with approximately rectangular inlet and outlet of substantially the same size in front of a typical conical horn throat. The sound chamber transforms the curvature of the fan shaped wave front that results from a conical horn throat into a wave front that approximates a planar or curved rectangular ribbon of sound. The invention claims advantages against the first prior art example, but at the expense of higher complexity, larger dimensions and eventually greater total line-array volume and mass.

In PCT published patent WO 2012/018735 A1, Donarski teaches us how to realize a plane wave front at the waveguide rectangular output by using two successive waveguides, the first being conical from the driver circular output to an annular output and the second with an annular input to a rectangular output. In both waveguides, vanes are used to address the interference problems at higher frequencies because of the increased dimensions of the air passages. Just as the previous prior art examples, this approach leads to very long, complicated and expensive waveguides, further increasing the length of the single line array element and the volume and the mass of the entire line array group.

None of the examples quoted, nor the art, to our knowledge, teach us how to make compact waveguides with precise wave front control up to the highest audible frequency range, having the possibility to precisely keep a predetermined wave front curvature at different output heights, expansion rates and axial lengths, at the same time being equally suitable for all the variety of available compression drivers. What is neither disclosed nor suggested in the art, is an acoustic waveguide that does not have the problems and limitations of waveguides in prior art, as described above.

SUMMARY OF THE INVENTION

The invention and the features thereof will be understood more clearly and fully from the following detailed description of several aspects, with reference to some of the accompanying drawings which might not be referenced consecutively, but rather when a particular aspect needs explanation or visualization. Referring now to the drawings in FIGS. 2A and 3B, the waveguide shown therein comprises three consecutive wave propagation passageways, virtually divided by two folding regions along its axial extension from the radial input up to the substantially rectangular output and all elements are shaped between an internal body and a shell enclosing it at a distance.

As shown clearly in the figures, the wave front created by the compression driver, expands radially outwards into the first passageway, creating a cylindrical wave front at the waveguide radial input, propagating between two substantially parallel input walls. Depending on the predetermined expansion rate, the distance between these wave forming walls starts increasing from a given diameter on in order to keep the expansion. Up to such a diameter, a relatively wide region with parallel walls is available for creating the most and equally suitable folding region with an adaptably changeable diameter.

To better understand the most important aspect of the invention, which is the practical advantages of the first, aforementioned radial expansion, FIG. 3A illustrates two examples of compression drivers radiating sound waves into the radial entrance of the waveguide. Different horn cut off frequencies, and different expansion types, are exemplified as charts, illustrating what should be the actual distance between the two input walls, referred to hereinabove as being substantially parallel, in order to accurately follow the law of expansion. The first example in the left chart is for one-inch compression driver with an added conical insert between its output and the radial waveguide input, whose surface areas are substantially equal. The expansion rate of the input area in radial direction, away from the axis, is calculated and graphically presented for two frequencies 800 Hz and 700 Hz, and for two expansions—hypex (hyperbolic-exponential) and exponential. As can be realized from examining the four expansion curves on the left chart in FIG. 3A, the distance between the two wave forming walls in fact decreases at first, with the increasing of the radii to a very widespread minimum region around which the walls are substantially parallel. This region of about 40 mm is surprisingly wide, lying somewhere between 30 mm and 70 mm radii. The existence of this wideness of practical radial expansions is neither intuitive nor obvious and is conveniently used by the invention to provide very precise and equally precise wave folding regions within quite a large range of folding diameters, practically between 60 mm and 140 mm, in our example. The actual internal folding diameter, shown for this circular output compression driver, is set at 80 mm with about 4 mm distance between the walls, which distance moves the corresponding quarter wavelength frequency above 20 kHz.

To further consolidate this first aspect of the invention, a radial-output large format compression driver is exemplified on the right chart in FIG. 3A, having the output area of a typical 2-inch circular output driver, and is directly attached to the waveguide radial input with the same surface area, at a diameter of about 3 inches. The same type of hyperbolic and exponential expansion calculated and drawn on the chart is used, having now 400 Hz and 300 Hz frequencies, demonstrating again the same wide and tightly neighboring region between the walls, extending from 50 mm to about 100 mm radii, meaning a very precise and wide folding zone positioned between the 100 mm and over 200 mm folding diameters. The actual internal folding diameter, shown for the annular output compression driver, is set at 140 mm with about 7 mm distance between the walls, which distance moves the corresponding quarter wavelength frequency just above 12 kHz.

The possibility to freely assign the diameter of the first waveguide folding region anywhere within this equally distanced zone between the walls for more than double increase of the radii, will be used later on to declare further two very important aspects of the invention.

Referring now to the drawings in FIG. 3B, the waveguide shown exploded therein comprises an internal body 12 and a shell 14, enclosing the entire air channel passageway 16 between them. Generatrix surfaces 13, shaping the air channel passageway, are included in the figure, to better illustrate some of the invention aspects. As shown clearly in FIG. 3C, wherein the entire air channel 16 is virtually intersected and exploded axially to three consecutive air channel passageways 16*a*, 16*b* and 16*c*, the two folding regions 26 and 27 could be distinguished by their different wave traveling directions and expansions. The first folding region is the end of the radial wave expansion and the beginning of a conical expansion characteristic of the second air channel passageway, which extends up to the second folding region and resembles a conical frustum shell, being sideways restricted by two pairs of symmetrical vertical side wall forming surfaces, defining two pairs of conic sections 25*b* and 25*d*. The folding region 27 is formed between the latter conic sections, and consists of two symmetrical halves on both sides of the vertical axial plane of symmetry.

As illustrated in FIG. 3C, the third air channel 16*c* comprises two symmetrical halves contiguously converging up to the common output, each half having different lengths of the individual wave traveling pathways, but all keeping in a generally horizontal direction. Thoroughly examining any two consecutive individual air channel path lengths accumulated from the last two channels, will probably disclose one of the most important aspects of the invention and the main function of the middle air channel 16*b*, being to equalize these lengths, thus time-aligning their individual wave propagation times. An alternative view of the channel 16 is illustrated partially cross-sectioned on bottom, while one orthogonally symmetrical quarter is radially exploded to visualize a number of individual air channels 17 having different folding angles, but equal individual pathway lengths.

Hereinafter, the second air channel passageway 16*b* will be referred to as "time alignment" element and a further aspect of the invention will be outlined, to make the physical geometry of this middle air channel passageway control all the waveguide properties and parameters. The four driving dimensions characterizing the waveguide and defining the geometry of the "time alignment" passageway are: total width-D, total height-H, total length-L, and width-W of the waveguide output. The only missing driving dimension is the cylindrical circular input diameter, which is ingredient of the first radially expanding passageway and is defined by the actual output configuration of the compression driver.

If and when the first two driving dimensions H and D are in proportion of about two to one, i.e. their ratio is about 2, the first time alignment criteria is satisfied. With this ratio, all the individual partial wave fronts are traveling along substantially identical accumulated path lengths from the input to the output. Here is the logical reason to assign the name "time alignment" region to the air channel between the two folding regions and to the walls physically restricting this air.

When the first criteria are satisfied, i.e. H/D equals two, a second set of criteria of a predetermined folding angle, for instance, might be satisfied. By making length of waveguide L one half of width D, i.e. the ratio D/L equals 2, about a 45 degree first folding angle results. This second criteria might be further optimized at different folding angles, although it seems that a 45 degree folding would minimize reflections and/or the standing waves formation at the folding regions. As so far clarified, the folding angle criteria are limiting the waveguide length, or vice versa, i.e. if the length of the waveguide is predetermined to satisfy the expansion rate needed to expand the output area of a given compression driver, then the folding angles have already been automatically predefined.

The width of the waveguide output 34, substituted by W, is the last driving dimension, which might be fixed at some predetermined value in order to satisfy some additional criteria, i.e. to be smaller than one half of the highest frequency wavelength. Specifying the width W by any criteria, however, is actually specifying the output area of the waveguide, which area is equal to the already specified height H multiplied by width W. The waveguide output area defines the internal conical frustum floor diameter on the output plane. When the output area is fixed and a compression driver output area 11 is predetermined, either the expansion rate is automatically fixed by a given folding angle and waveguide length, or a predetermined expansion rate defines a new set of waveguide length and folding angle.

The actual value of the first folding region area depends on its position along the entire wave traveling path and could be conveniently controlled by the inner diameter 25*a*, i.e. the peripheral diameter of the input wall face of the internal body.

It will be appreciated, of course, that the several considerations pointed out hereinabove should be properly correlated in order to produce a waveguide suitable for a particular application.

At this point, it is time to get back to the first of the aforementioned two aspects of the invention in connection with the availability of a wide range of precise first foldings, hereinabove referred to as the width D of the air channel passageway. The upper ratio H/D, might be kept constant, thus keeping any predetermined wave front curvature by varying the width D of the air channel within the reasonable range of values between the substantially parallel wave front forming walls of the first air channel passageway, which range proves to be quite wide.

Referring back to the two practical examples from FIG. 3A, this aspect of the invention boils down to defining a respective range of possible waveguide heights, all satisfying predetermined curvature of the wave front at the output. In case of planar output wave, meaning H/D equals 2, these ranges are 120 mm-280 mm for the small-format compression drivers on the left chart and 200 mm-400 mm for the annular output large format compression driver on the right chart in FIG. 3A. All in all, for any single line array element of reasonable height, a proper radial input waveguide having such height and a desired curvature might be provided, by simply varying the passageway width D.

The second aspect of the invention relating to the availability of this wide range of diameters giving precise wave folding, would be the possibility to elliptically so reshape the circularity of the first folding region as to have an elliptical ratio between its major and minor axes more than twice, up to a point where precise wave front folding is possible between the two substantially parallel input walls which are already sufficiently near. This elliptical reshaping of the periphery of the first passageway is a brute force to significantly change the lengths between the individual air channel pathways along the full 360 degree axial circle in radial direction, making real the possibility of shorter planar waveguides or deeper wave front curvatures, or both at the same time to some extent. Moreover, the elliptic prolonging might be oriented vertically or horizontally thus further brutally changing the difference between the aforementioned H/D ratios along the two orthogonal planes of symmetry.

An object of the invention is to provide a radial-input waveguide having the same precision and suitability for all compression driver types, both popular and newcomers. These newcomers include: small and large-format annular output compression drivers, and small and large format radial-output compression drivers, as well as dual of the latters.

Still another object of the invention is to provide a way of increasing acoustic energy density at the input of a high frequency line array element by stacking a number of single waveguide elements side by side, spread horizontally at an angle to each other, supplying multiple driver energies to a single common input area of the high frequency line array element or of the horn throat. This approach is particularly suitable for compact line array systems, when a single large compression driver could be substituted by a number of smaller and cheaper drivers, usually having larger uppermost frequency band capabilities. For the biggest line array systems having a long sound coverage of several hundred meters, these higher high frequency power capabilities are crucial, to compensate the enormous increase of sound wave attenuation in the air with the distance. Other high frequency disturbing phenomena might include variations of some air parameters like humidity, temperature, absolute pressure and wind, as well as their gradients and gradient directions, if and when applicable. These phenomena might refract and/or disperse significant part of the high frequency energy, disappearing away from the audience plane.

Yet another object of the invention is to further drastically increase the high frequency supply in order to oppose the above mentioned phenomena by providing a way of further significantly increasing the acoustic energy density at the input of the high frequency line array element, i.e. stacking vertically a number of already horizontally stacked waveguide element groups, side by side in a vertical line, or in a slightly inclined line. This approach might enormously increase the acoustic power per unit area at the commonly united waveguide output, in comparison with a single compression-driver, in practice between four-fold and a dozen-fold, for matrixes of 2×2 and 3×4 drivers-waveguides combination, respectively. Alternatively, this approach might be used to reduce the electrical power of individual drivers by the same amount, thus increasing the quality by reducing the harmonic distortion levels for the same sound pressure level. As should be obvious from the aforementioned remarks, either the power capability or the sound quality could fully benefit from the multiple arrangements, or else bout might be improved to some extent.

DRAWING NUMERALS

Figure 1:
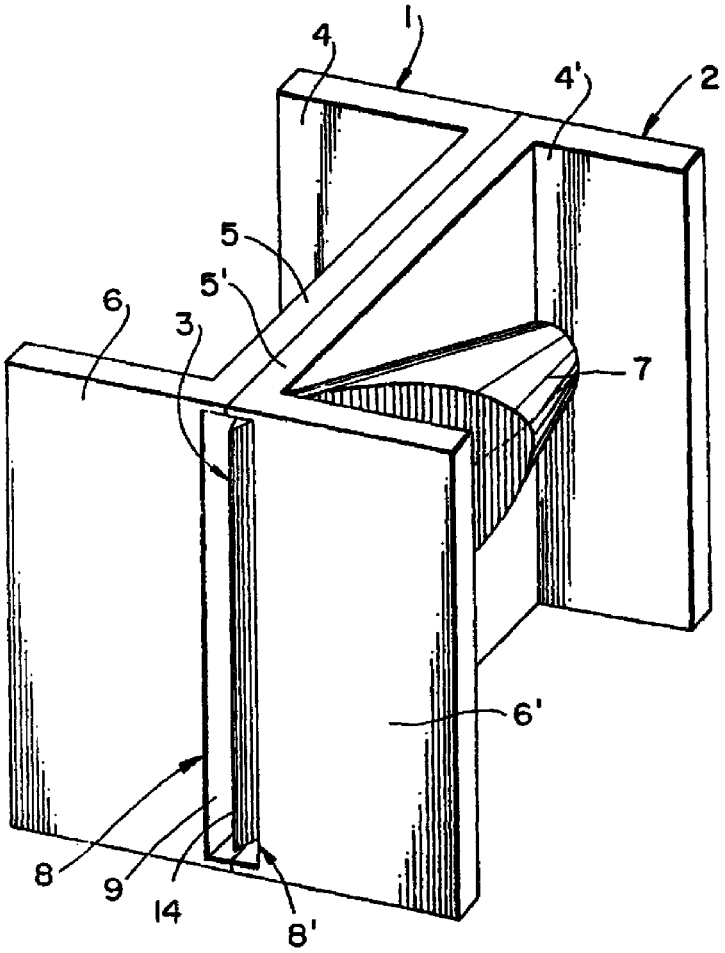
FIG. 1 PRIOR ART
FIG. 1 is a prior art illustration of "Sound Wave Guide" [U.S. Pat. Des: 5,163,167]

10—Radial input waveguide
11—Compression driver output area
12—Internal body
13—Waveguide wall forming generatrix surfaces
14—Shell, housing the internal body
15—Compression driver, 15*a* Annular, 15*b* Circular, 15*c* Radial, 15*d*—Dual radial output
16—Air channel passageway of the waveguide
16*a*—Radial input air channel sector/zone/region
16*b*—Time alignment middle air channel passageway
16*c*—Wave collecting and directing to the output, third air channel passageway
17—Plurality of individual sound wave guiding passageways composing the entire channel
18—Substantially parallel input wall forming surfaces, 18*a*-internal, 18*b*—external
19—Cylindrical circular input area of the radial input waveguide
20*a*, 20*b*—Generally non parallel axial and conical frustum surfaces
20—Projected annulus area between two conical frustum floors on the output plane
21—Frustum conical inserts of waveguides for annular output compression drivers
21*a*—Conical insert of waveguides for circular output compression drivers
22*a*,22*b*—Substantially vertical internal body's side wall forming surfaces
22*c*/22*d*—Substantially vertical shell's side wall forming surfaces
22*e*—Side walls of the shell, 22*i*—Side walls of the internal body
23—Substantially rectangular waveguide output area
24*a*—Input wall face of the internal body, 24*b*—Input wall face of the shell housing
25*a*, 25*c*—Input wall peripheries
25*b*, 25*d*—Two pairs of conic sections between surfaces 22 and conic frustums 20*a*, 20*b*
25*a*-25*c*—First folding region formed between respective conic sections, denoted as 26
25*b*-25*d*—Second folding region formed between respective conic sections, denoted as 27
26—First wave folding region between the two input wall peripheries
27—Second folding region between respective conic sections 25*b* and 25*d*
28—Annular axial cross-sectional area nearby first folding region
28*a*—Periphery of the annular axial cross-sectional area 28 substituted with D
29*a*, 29*b*—Conical top/bottom walls of the internal body—29*a*, and of the shell—29*b*
30—Plurality of vanes between two pairs of side walls
30*b*—Plurality of extended vanes between two conical top/bottom walls 29*a* and 29*b*
30*a*—Plurality of extended vanes towards the input between two parallel input walls
31—Thin vertical guiding vane 31, lying into vertical plane of symmetry
32—Vertical axial waveguide plane of symmetry
33—Vertical waveguide output plane, substantially normal to the axis
34—Width of the waveguide output, area substituted by—W
35—Height of the waveguide output area—H
36—Output extension/extrusion between output plane 33 and extruded output plane 37
37—Extended/extruded vertical output plane
38—High frequency line array element

DESCRIPTION OF THE INVENTION

Figure 2A:
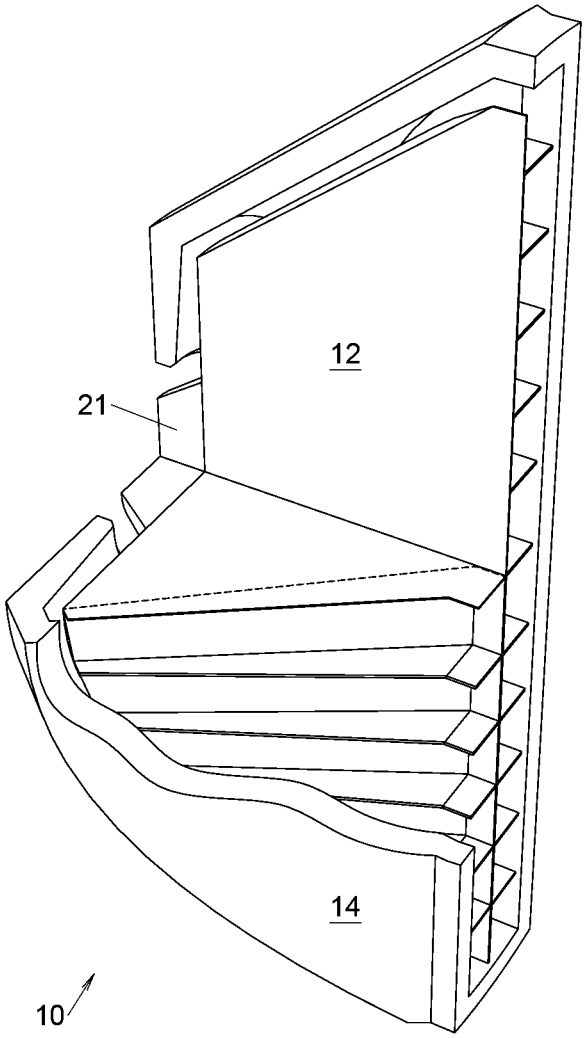
FIG. 2A is the perspective partially cross-sectional schematic view of the radial input waveguide for annular output compression drivers.

For better understanding of the gist of the radial-input waveguide, a number of basic elementary surfaces are used to illustrate how the waveguide walls are generated. The walls restrict an air channel, or a plurality of individual air channels, guiding sound wave propagation from a compression driver output to the waveguide output. FIG. 2A illustrates a principal waveguide 10, consisting of internal body 12 which is enclosed by shell 14 at a distance. To the waveguide input, an appropriate compression driver 15 is firmly attached. In FIG. 3B all generatrix surfaces 13, forming the walls between which sound waves propagates, are pictured on its uppermost left side. They form an internal body 12, shell internal walls 20*b*, 24*b* and 29*b*, and an air channel 16 positioned between shell 14 and the internal body 12. Air channel 16 consists of three consecutive virtual passageway elements 16*a*, 16*b* and 16*c*, all shown as exploded perspective view in FIG. 3C.

Two vertical and substantially parallel surfaces 18*a* and 18*b* from FIG. 3B, form an input wall face 24*a* of internal body 12 and an input wall face 24*b* of shell 14, respectively. Two axial and generally non-parallel regular conical frustums, forming conical frustum shell between lateral surfaces 20*a* and 20*b*, are lying on their larger floors on a common plane coinciding with an output plane 33 of waveguide 10 and extend their axial lengths to one of two vertical input wall forming surfaces 18*a* and 18*b*, respectively. The crossing line of the intersection between 20*b* and 18*b* forms a substantially circular input wall periphery 25*c* of shell 14, while the crossing line of the intersection between 20*a* and 18*a* forms input wall periphery 25*a* of internal body 12. Between these two substantially circular peripheries, 25*a* and 25*c*, the first folding region 26 of the waveguide is obtained, and is intersected there in FIG. 3C, to separate the first radially expanding air channel element 16*a* from the second conically expanding time alignment air channel element 16*b*. Two vertical surfaces, 22*a* and 22*b*, in FIG. 3B are tangential to input wall periphery 25*a* of the internal body 12 and are symmetrical on both sides of a vertical plane of symmetry 32. These surfaces 22*a* and 22*b* intersect on output waveguide plane 33, and they cross inner frustum-conical surface 20*a*, thus forming two symmetrical conic sections 25*b*, on both sides of the vertical plane of symmetry. In fact, internal waveguide body 12 is constrained by the following surfaces: two vertical surfaces 22*a*, 22*b*, conical surface 20*a* and vertical surface 18*a*. On the vertical plane 18*a*, a projected circular periphery 28*a* to face periphery 25*a* is available, forming an annular axial cross sectional area 28 between the two peripheries, which area is substantially equal to the folding region area 26. On this region the wave front is folded and conical frustum shell-like generatrices of the second air channel 16*b* with increased thickness towards a common frustum floor plane are shaped. The frustum large floor plain coincides with the waveguide output plain 33, whereto on, defining a projected annulus area 20, numerically equal to the rectangular waveguide output area, and defining at that plane the heights of the internal body and the shell.

Two symmetrical pairs of vertical surfaces, 22*a*/22*c* and 22*b*/22*d*, each pair positioned on one side of the axial vertical plane of symmetry 32, and the two vertical surfaces from each pair are tangential to the frustum shell small floors and form one symmetrical half of the rectangular output width 34 on the waveguide output plane 33, further cutting two pairs of conic sections 25*b* and 25*d* from the frustums and each pair of these conic sections defining one symmetrical half of the second folding region 27 and one symmetrical half of the third air channel passageway 16*c*, respectively. The third air channel passageway 16*c* is shaped between the two vertical surfaces from the second folding region up to the respective half of the waveguide output. In fact, the inner walls of the shell are shaped by the following four external air channel restricted surfaces: 22*c*, 22*d*, conical surface 20*b* and vertical surface 18*b*. The shell housing is constructed of proper material, with predetermined thickness, suitable external wall shape and appropriate wall bracing.

Figure 3A:
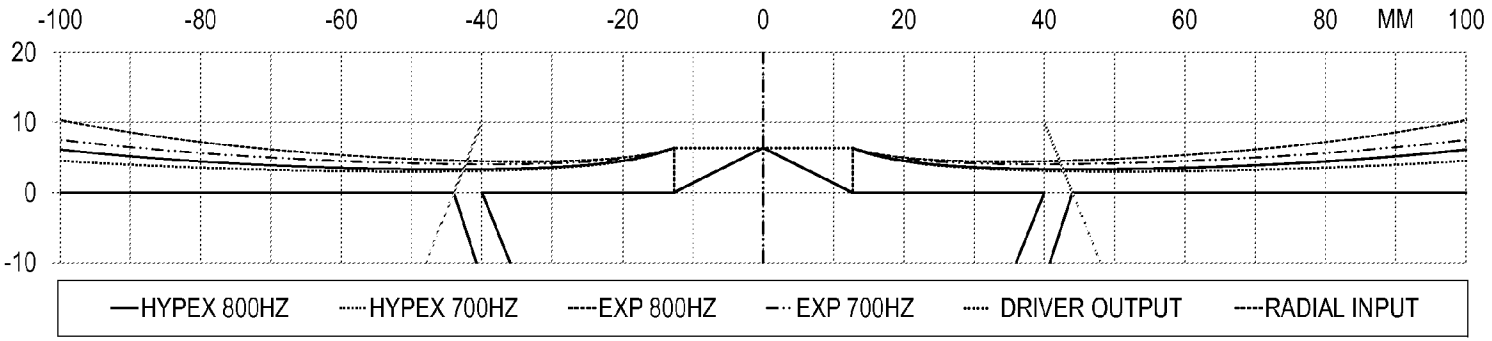
FIG. 3A illustrates two examples of radial expansion into the radial entrance of the waveguide for different horn cut off frequencies, and different expansion types.
Figure 3A:
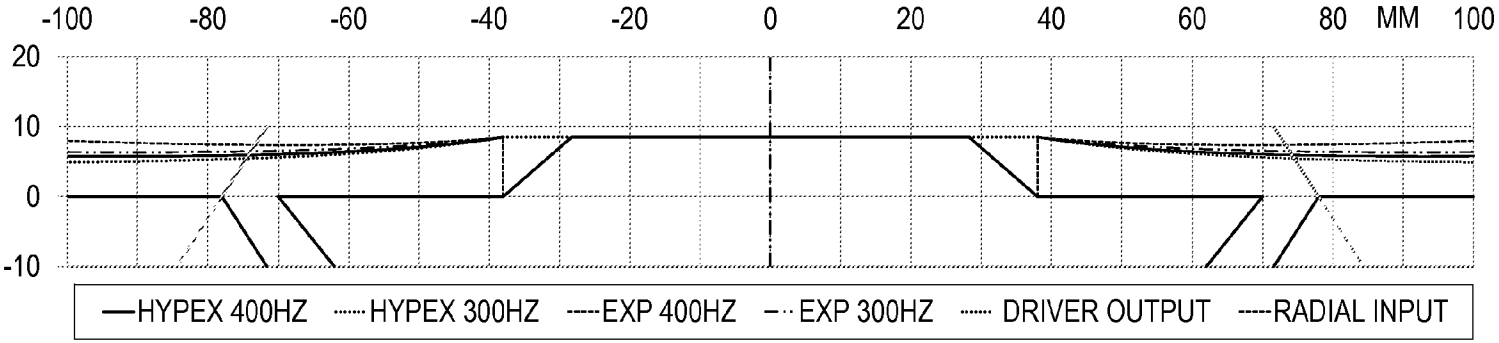
Figure 3B:
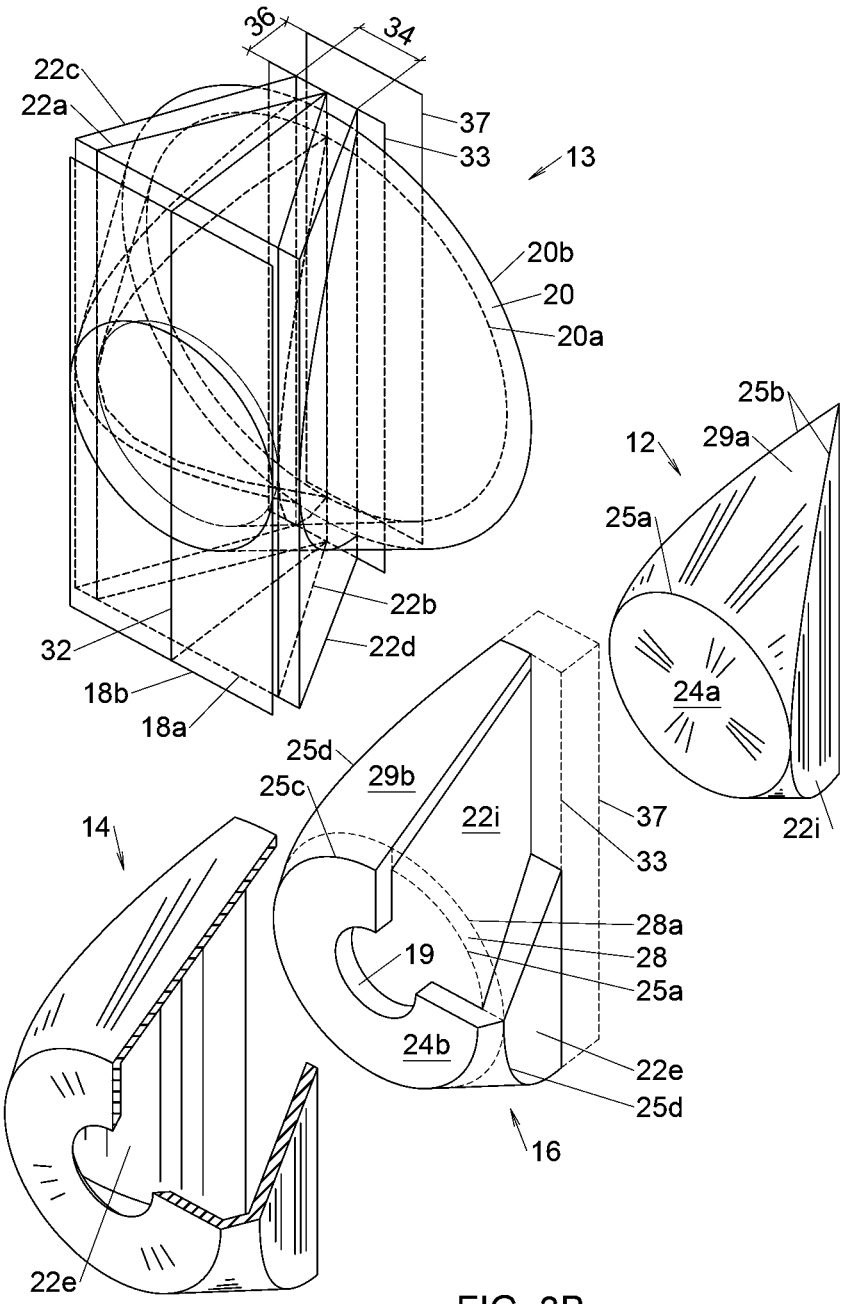
FIG. 3B is an illustration of the waveguide internal and external wall formation by using generatrix surfaces, which define air passage walls actually guiding the sound wave front.
Figure 3C:
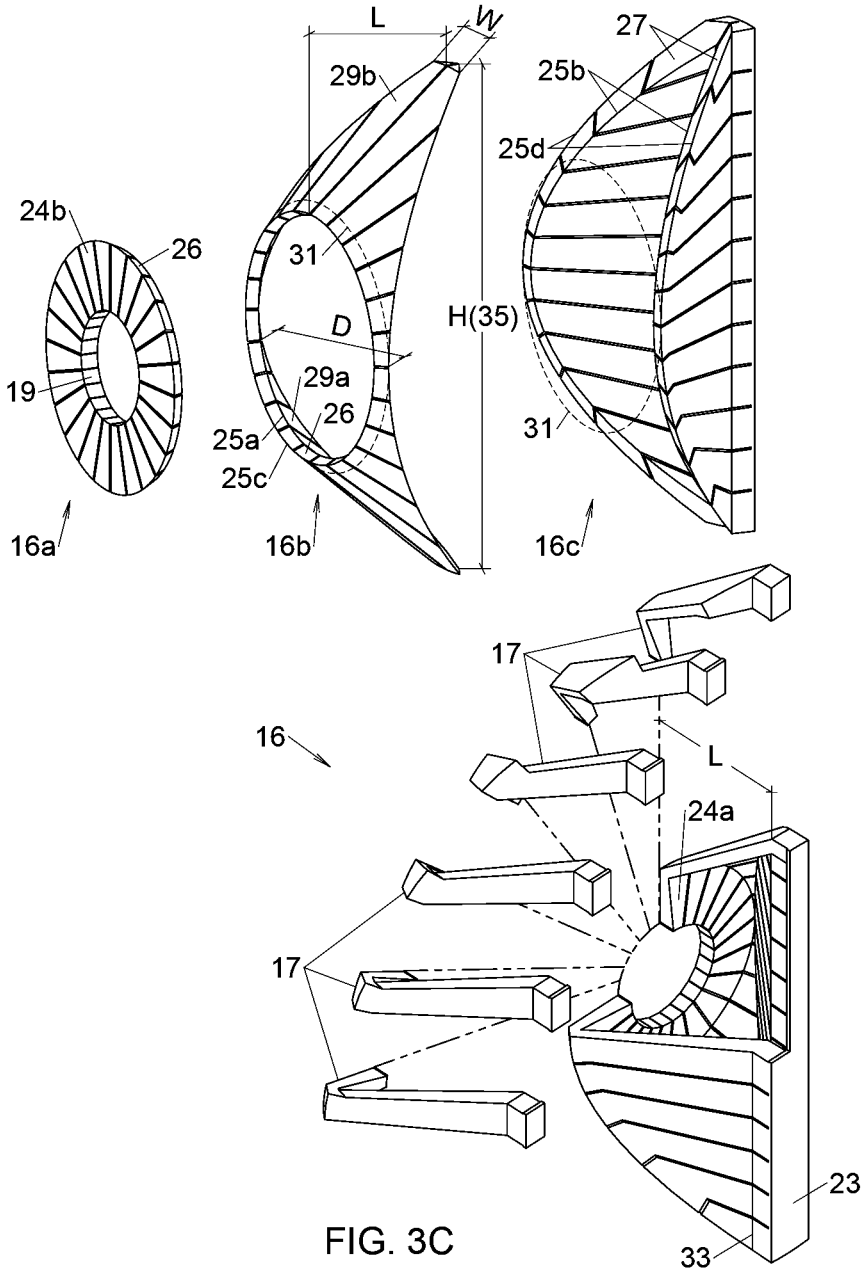
FIG. 3C is the exploded perspective cross-section view of the waveguide air channels.

As can be realized by inspecting the drawings in FIGS. 3A and 3B, top/bottom walls 29*a* of internal body 12 and top/bottom walls 29*b* of shell 14 are formed by the two frustum conical surfaces 20*a* and 20*b*. These top/bottom walls are sideways restricted by respective side wall forming surfaces 22*a*, 22*b*, 22*c* and 22*d*, while side walls 20*a* and 20*b* are top/bottom restricted by conical frustums 20*a* and 20*b*.

The second air channel element 16*b* is functioning as a mechanical time alignment element by the ratio of its height H, generally equal to the waveguide output height, to its horizontal width D coinciding with outer axial annular cross-section diameter 28*a* in the absence of ellipticity. These two dimensions are designated as 35 and 28*a*, respectively. Having this ratio H/D equal 2/1, meaning the air channel width being one half of the waveguide output height 35, is making the sum of any two individual consecutive air channel paths equal, which fact is not depending much on the total axial length L of air channel 16 substantially equal to the length of the last wave collecting and directing to output 23 air channel element 16*c*. Having this ratio higher than 2, results in convex curvature wave front at waveguide output 23, and besides, to some extent the depth of the curvature is proportionate to the ratio. This simple physical time alignment mechanism is due to the increasing differences between the individual air channel paths towards the vertical and horizontal extremes, with the increasing of ratio H/D above 2. In rare cases, a concave wave front curvature might be desired, which requires aligning D to be larger than half the height H, i.e. having H/D ratio smaller than 2. Conversely to the previous convex case alignment, to some extent, the smaller the ratio bellow 2, the higher the concave curvature of the wave front at the output of the waveguide.

Figure 8A:
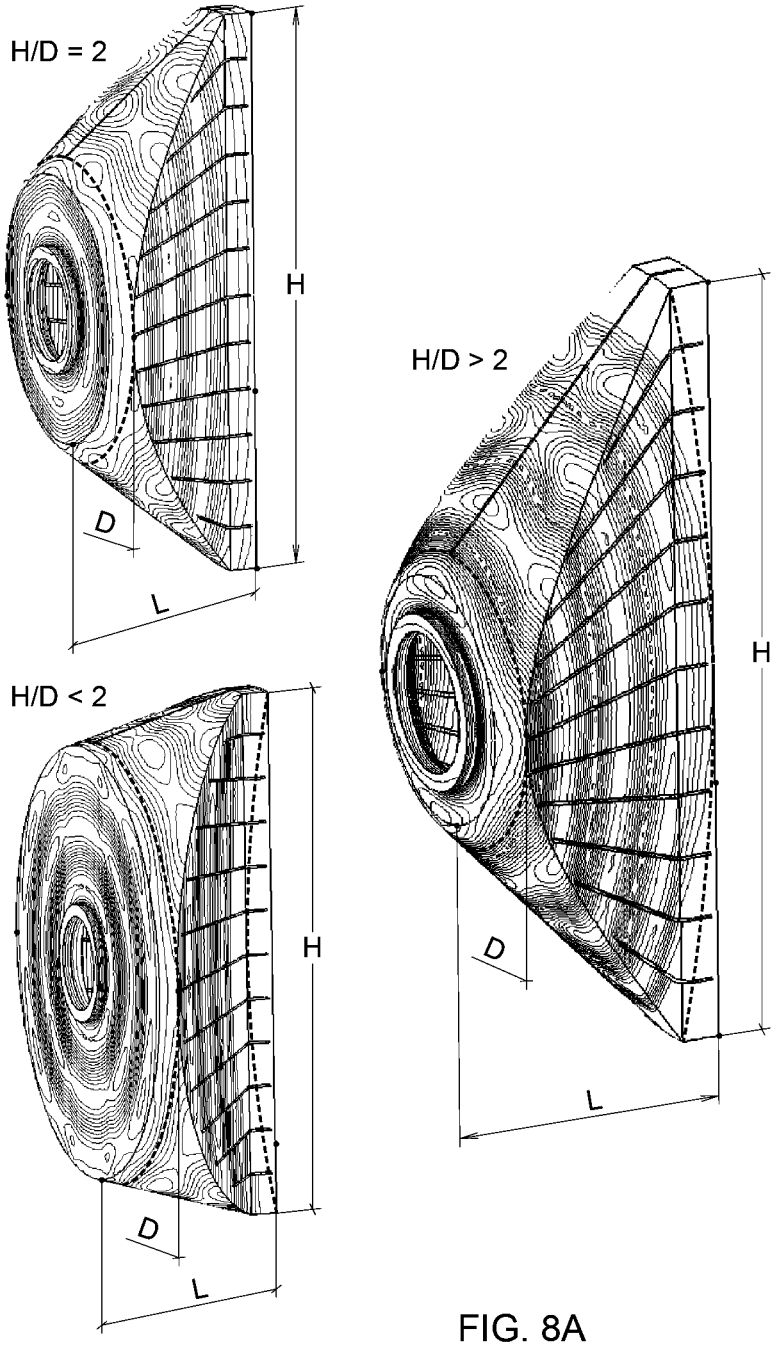
FIG. 8A illustrates the wave front propagation and formation of planar, convex and concave output wave fronts, depending on H/D ratio of the time alignment sector.

FIG. 8A shows visualized illustrations of otherwise invisible sound wave field for 12500 Hz frequency as isobar contours on walls for three cases of wave fronts at the waveguide output, depending on H/D ratio. These sound pressure contours are generally at right angles to the walls, which are excluded from the pictures for clarity. The uppermost illustration demonstrates planar wave front at the waveguide output in case of H/D=2. The mid positioned illustration shows convex wave front for H/D>2. The lowermost picture illustrates a concave wave front where H/D<2, which would probably be the least useful curvature and is presented just for completeness, although in some special rare cases concave wave front might be strongly required. Output extruded region 36 could be conveniently shaped as shown with dashed lines, to fit a proper physical horn input curvature in case of convex or concave horn inputs, as illustrated in FIG. 8A.

Plurality of thin wave guiding vanes 30 are disposed contiguously between the internal body's side vertical walls 22*i* and the shell's vertical walls 22*e* starting in the vicinity of conic sections 25*b*, 25*d*, denoted as second folding region 27, and extending to the waveguide output plane 33, which is substantially normal to the waveguide axis, as shown in FIG. 3B. The wave guiding vanes are forming a plurality of individual air channel passageways 17 starting at the second folding region, and extending to the waveguide output plane, dividing its individual input and output normal to the wave traveling path areas, so as each one carries substantially proportional energy to its proportion of the individual output area from the total output area, and all air channels having substantially identical expansion rates.

Figure 2B:
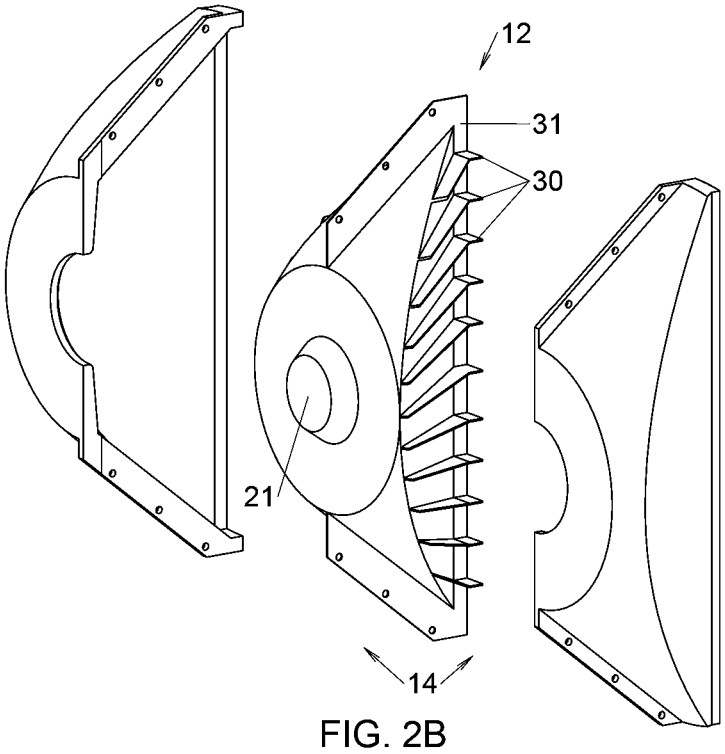
FIG. 2B is the exploded perspective schematic view of the radial input waveguide for annular output compression drivers, where its shell sandwiching the internal body.
Figure 2C:
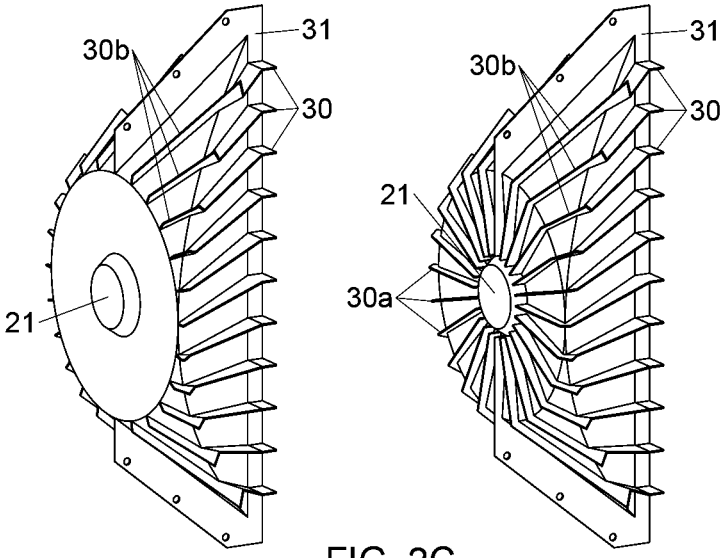
FIG. 2C is the perspective schematic view of two alternatives of the internal body, having vanes 30 extended to the first folding—30*b*, and to the radial input—30*a;*

Wave guiding vanes could be further extended inwards, marked 30*b* in FIG. 2C, towards the sound wave source in generally cone generatrix direction from the second wave folding region 27, disposed contiguously between the two substantially conical frustum and generally non-parallel top/bottom walls 29*a* and 29*b*, to the first wave folding region 26.

Even if it doesn't help much, vanes 30*b* might be even further extended inwards in generally radial direction from the first folding region to the waveguide input, marked 30*a*, up to a cylindrical circular input area face 19, contiguously axial to the internal body input wall face 24*a* of the waveguide, dividing the first air channel into individual substantially radial sound wave passageways, each one keeping expansion rates identical to its own respective predecessor from the last two air channel passageways.

If vanes 30, 30*b* and 30*a* are excluded from air channel 16 altogether, the waveguide demonstrates much the same performance, except for the uppermost frequency band, where the energy density at vertical extremes of the waveguide output area 23 might be slightly reduced. It should be noted, thou, that vanes 30 which are between vertical side walls 22*i* and 22*e* of the third air channel 16*c*, are the most important vanes, as they equalize phasing and high frequency energy distribution of the individual partial air channel outputs along the vertical waveguide output area 23. Moreover, vanes 30 are very important for vibration control of otherwise substantially flat and relatively large side walls of internal body 12 and/or of shell housing 14 by increasing their rigidity and damping. This vibration control might be the only reasonable idea to justify extending vanes 30 to waveguide input 19.

Rather than extending vanes 30 from second folding region 27 inwards, it seems to be more appreciable to extrude them from output plane 33 outwards at a predetermined distance 36, as illustrated in FIG. 3B. The same extrusion, normal to a predetermined wave front at output 23, should be done with the shell wall periphery at output plane 33, up to an extruded output plane 37. A thin vertical wave guiding vane 31, lying on vertical plane of symmetry 32 between two normal and extruded output planes 33 and 37 is added, which vertical vane connects waveguide vertical output extremes of shell 14. This vertical vane 31 in the vertical plane of symmetry 32 might be extended over most of internal body 12 peripheries in this plane and conveniently used as an internal body frame to be sandwiched between the two halves of shell 14, which is pictured in FIG. 2B. Output vane extrusion between planes 33 and 37 of predetermined distance 36 in FIG. 3B, further horizontally equalizes the wave front phasing and energy distribution on output surface area 23, and prepares the sound waves for precise wide horizontal opening of the high frequency line array element. As aforementioned, this extrusion region could be conveniently physically shaped, including shortening or elongating of some of the extruded vanes, to a proper wave front convex or concave curvature, if appropriate, in order to fit a horn with respectively curved physical input area. Moreover, vanes might be properly distributed to direct more energy towards specific parts of the horn input area, say downwards or upwards, thus controlling the vertical lobe of the horn polar pattern towards the respective direction.

DESCRIPTION OF PREFERRED EMBODIMENT AND SEVERAL ALTERNATIVES

Hereto above described invention could be characterized by an embodiment shown in a partially cross-sectional exploded view in FIG. 2A and as a sandwiching alternative, again in an exploded view, in FIG. 2B. It is shown to fit an annular output compression driver 15*a* of mid-format, meaning it has an equivalent area of 1 inch circular output compression driver, but might be used for any diameters or any output areas. It has a short, substantially frustum conical antireflective insert 21, axially disposed contiguously with its larger floor to the internal body input wall face 18*a*, and extending generally to the circular output face 11 of the respective counterpart compression driver, such that a planar sound wave at the annular output driver area is transformed to a radially expanding wave front, right at waveguide input 19. Wave front refracting is obviously very effective and precise, due to smaller width dimension of the input passageway. Waveguide input area 19 is substantially circular with a cylindrical wave front and is substantially equal to driver's output area 11. The main embodiment has revealed precision phasing of the output wave front. The embodiment sample was with dimensions of only 4.2 cm total axial length, and 60 mm diameter at the folding—FIG. 2B. The model comprises two shells sandwiching an internal body, all made by reinforced plastic and having total weight of only 130 grams.

Even though in the main embodiment vanes were disposed contiguously between the vertical side walls of the inner body and the shell, for higher precision of the energy distribution along the waveguide output height and proper phasing, an embodiment without any vanes has been reduced to practice as an alternative, demonstrating much the same performance except at the highest frequencies, with much lower complexity and reduced demands for production tolerances. Two alternatives of an internal body with extended vanes to the first folding region and to the radial input respectively are pictured in FIG. 2C.

Figure 4A:
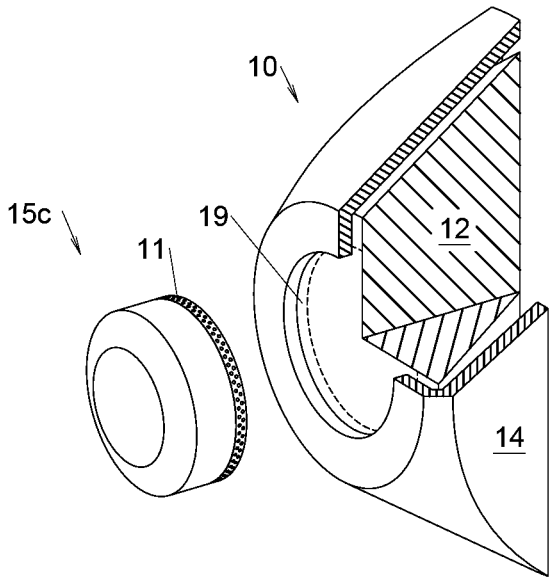
FIG. 4A is the perspective partially cross-sectional schematic view of the waveguide for a radial output compression driver, having its output 11 at its cylindrical end.
Figure 4B:
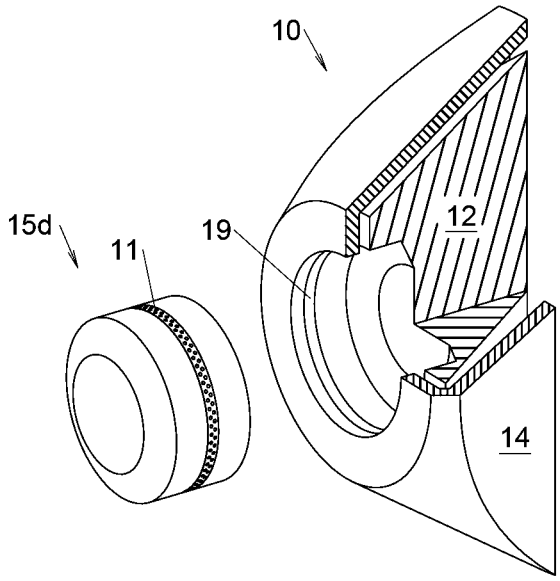
FIG. 4B is the perspective partially cross-sectional schematic view of the waveguide for a radial output dual compression driver.
Figure 5:
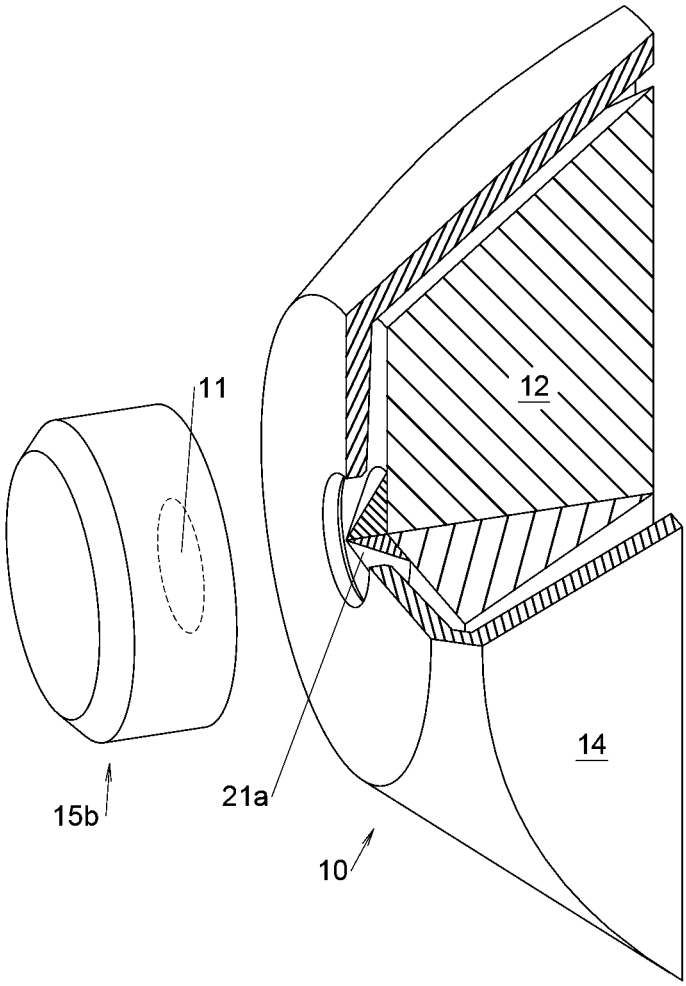
FIG. 5 is the perspective partially cross-sectional schematic view of a waveguide with conical input insert, for fitting standardized circular output compression drivers.

Another embodiment of the invention is pictured in FIG. 4A in a partially cross-sectional perspective view, diagramming the direct fitting of a radial output compression driver 15*c* to the radial input of the waveguide, with a properly shaped open circular entrance to accommodate and tightly fit the driver, so that its output area 11 coincides and opposes waveguide input area 19. More particularly, illustrated in FIG. 4B is another radial input waveguide of the invention that may include an axial cylindrical recess in its internal body 12, as deep as to tightly accommodate part of a dual radial output compression driver 15*d* and to position its output area 11 so as to coincide and oppose the waveguide input area 19. In the alternative embodiment of FIG. 5, the waveguide is having a circular input to fit standardized circular output compression driver 15*b*, which is properly attached opposing an antireflective conical insert 21*a*, disposed axially and contiguously to the input wall of the internal body 12, such that a planar sound wave at the output driver area 11 is transformed to a radially expanding wave front, right at waveguide input 19. The conical insert at the input is a useful option to reduce back to driver membrane reflection, and might have different predetermined forms, a particular position and might be of a special predetermined material.

Figure 6A:
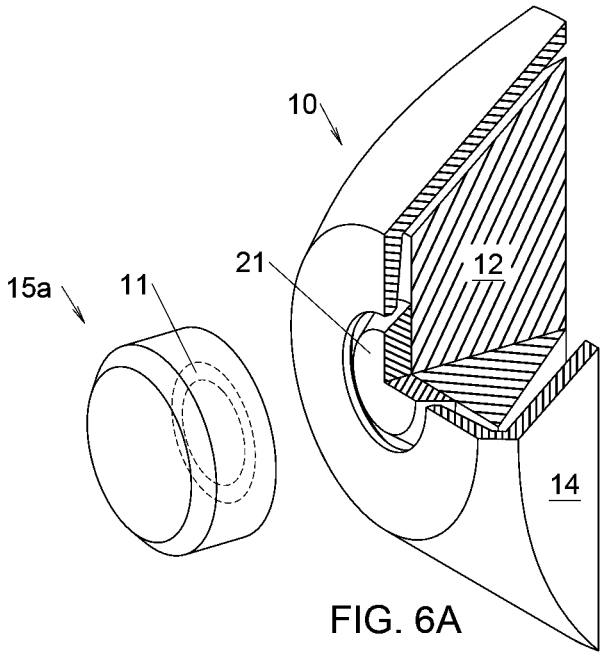
FIG. 6A is the perspective partially cross-sectional schematic view of a waveguide with a frustum-conical input insert, for fitting annular output large format compression drivers.
Figure 6B:
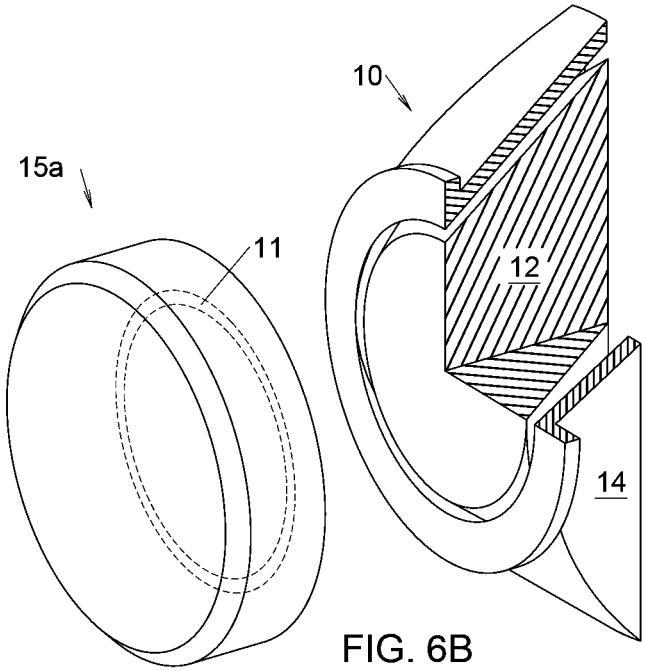
FIG. 6B illustrates the perspective partially cross-sectional schematic view of a waveguide for direct fitting large diameter large format annular output compression.

Large format compression drivers with annular membranes are commonly built with circular outputs of 1.4, 1.5 or maximum 2.0 inch diameters, just to share the same horn or waveguide inputs standardized for dome-type compression drivers. If these large format annular membrane compression drivers are to be used in line-array systems through the waveguide usage, this standardization is neither needed nor useful. A much more logical approach would be to build an annular output for such drivers with annular output diameters close to their voice-coil diameters, and to fit a very simple and straightforward phasing plug, as multiple slits to the annular output, just to mention one of the alternatives. A much more coherent wave front resulted with this approach, without the typical for the 2-inch circular outputs high frequency interferences, well covered in literature. FIG. 6A pictures such an embodiment for large format annular output compression drivers. As an inevitable transition region, an annular cross-section area in axial direction is formed around the maximum width of the air channel passageway, which region is conveniently used for realizing one of the embodiment modifications, which differs from the previous embodiments in that its first radially extending region is missing. This particular embodiment is pictured in FIG. 6B and will be used for direct fitting to large diameter large format annular output compression drivers, which might already have their own radial expansion regions integrated.

Figure 7:
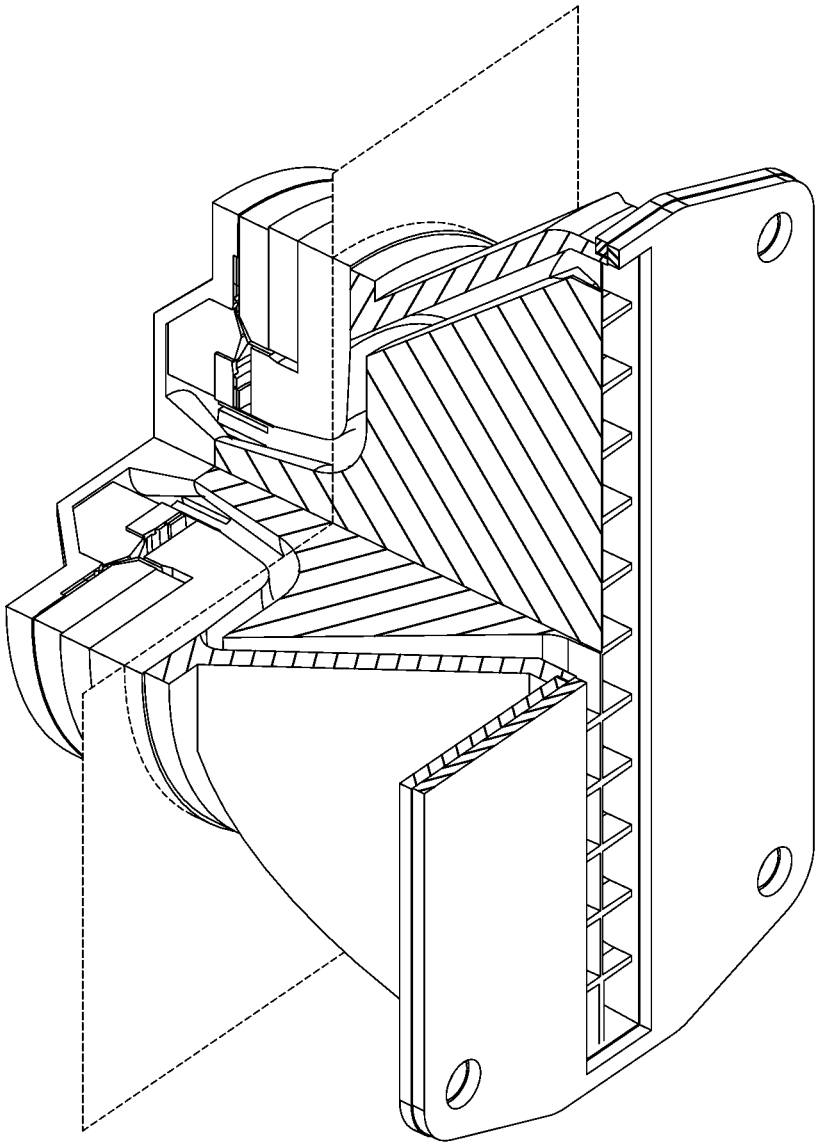
FIG. 7 illustrates a reduced to practice prototype of the integrated waveguide.

Some compression drivers might be completely integrated with their counterpart waveguides, appearing to have a single body with direct rectangular output. Not to be infringed by such examples, yet another embodiment of the invention is pictured in FIG. 7, having an internal waveguide body entering deep into the driver's structure, all the way to its other end. Even thou it might seems arguable whether this is a waveguide or a driver with an extended phasing plug, the dashed line traced cross-section plane would intersect around the bottom pole piece of the magnetic structure an area which reveals clearly the same radial input waveguide embodiment as pictured in FIG. 6A. This embodiment was reduced to practice and demonstrated the same excellent frequency response linearity and high sensitivity throughout the full spectrum from 800 Hz to 20 kHz, as the other embodiments.

Figure 8B:
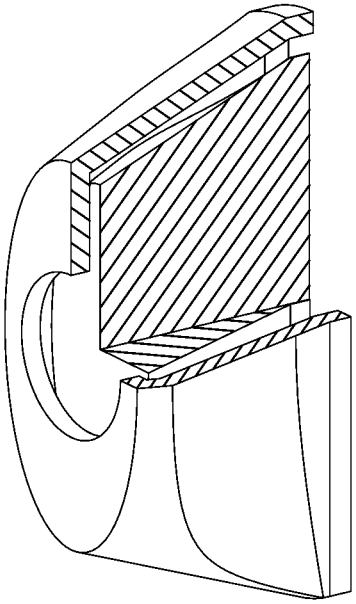
FIG. 8B and FIG. 8C illustrates waveguides with elliptically reshaped first folding region, vertically and horizontally oblong, respectively.
Figure 8C:
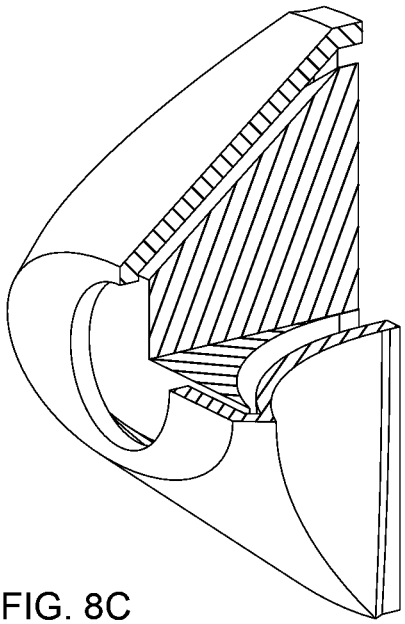

A specific embodiment of the present invention may provide an elliptically shaped first folding region in combination with arcuate convex or concave pairs of side wall wave guiding surfaces, defining not only substantially rectangular and planar output, but any vertically prolonged ellipsoidal output, either planar or respectively curved to follow a specific physical horn input shape and curvature. FIG. 8B and FIG. 8C show just two such varieties, the first having vertically prolonged first folding region and arcuate convex side walls, whereas the second has a horizontally prolonged first folding region and arcuate concave side walls.

Figure 9A:
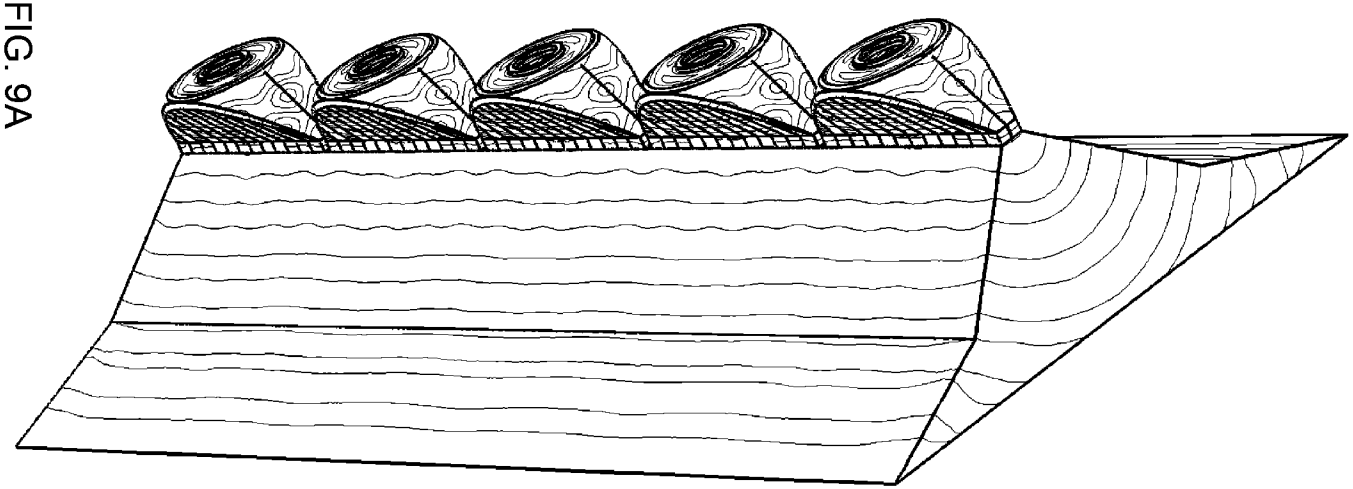
FIG. 9A illustrates the wave front propagation of a common wave front from 5 vertically stacked waveguides on a common high frequency line array element for 12 kHz frequency.

A system of five radial input waveguides vertically arranged in a line is illustrated in FIG. 9A showing the sound wave propagation and formation of a common wave front, in front of a common high frequency line array element or a simple horn, for 12 kHz frequency. Very evenly distributed common cylindrical wave front is propagating in front of the horn opening, which is clearly visible all the way along its height.

Figure 9B:
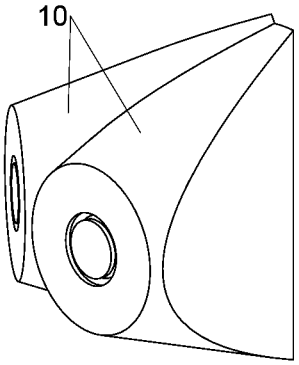
FIG. 9B is a simplified illustration of two horizontally stacked waveguides on a common high frequency line array element.
Figure 9C:
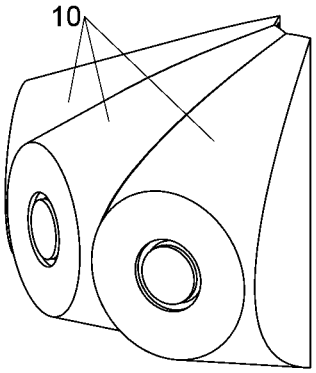
FIG. 9C is a simplified illustration of three horizontally stacked waveguides on a common high frequency line array element.

A system of two waveguides is basically illustrated in FIG. 9B, where the waveguides are stacked together side by side spreading in an angular fashion, both will be working onto a common input of a high frequency line array element with substantially the same input area as the sum of the two waveguides output areas. A system of three waveguides is pictured in FIG. 9C, horizontally stacked together side by side spreading in an angular fashion, and all three waveguides will be working onto a common input of a high frequency line array element.

Figure 9D:
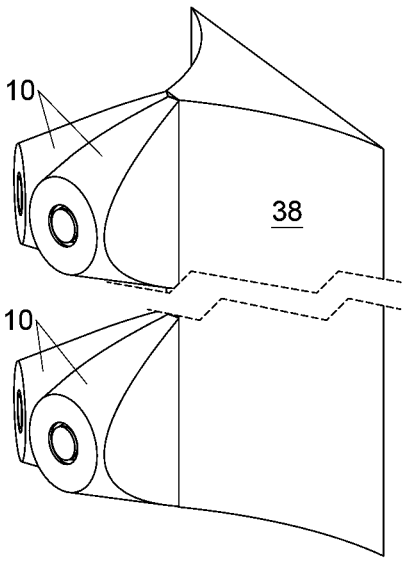
FIG. 9D is a simplified illustration of multiple vertical stacking of two already horizontally stacked waveguides on a common high frequency line array element.
Figure 9E:
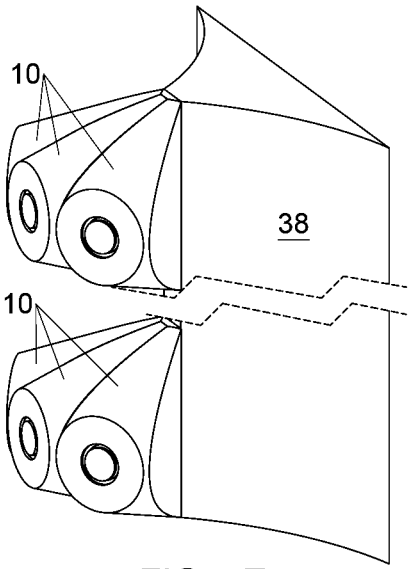
FIG. 9E is a simplified illustration of multiple vertical stacking of three already horizontally stacked waveguides on a common high frequency line array element.

FIG. 9D and FIG. 9E show simplified principal diagramming of the aspect of vertically arranging a number of already horizontally stacked groups of two and three waveguides, shown in each of the respective figures. The input area of the high frequency horn element 38 is substantially equal to the sum of the output areas of all stacked waveguides 10. The vertically arranged and stacked in line group might be in a straight line or a slightly curved line to physically fit a predetermined horn's multiple input curvatures.

A limited number of embodiments of the radial input waveguide have been illustrated and described herein. However, it is to be understood that the invention encompasses a myriad of the two folding region geometries which may be tailored to a variety of desired wave front output patterns. Furthermore, all these variations in the folding region geometries are realizable by virtue of the present invention.

What is claimed is:

1. A radial input waveguide comprising three consecutive passageways virtually divided by two folding regions along its axial extension from the radial input up to a substantially rectangular output being positioned on the waveguide output plane which is substantially normal to the axis, each consecutive passageway forming a different type of waves traveling in different directions and all three passageways are shaped between an internal body and a shell enclosing it at a distance, the first passageway is an outwardly radially expanding air channel, having its cylindrical circular input area face contiguously axial to the internal body input wall face and its input diameter and its input area substantially equal to the respective counterpart compression driver output diameter and output area, and forming a cylindrical wave front, radially expanding between the two substantially parallel input walls of the internal body and the shell up to said first folding region arranged on a pre-determined periphery, said periphery circularly or slightly elliptically shaped generally vertically or horizontally oblong, whereto from, wave front is folded and conical frustum shell-like generatrices of the second air channel with increased thickness towards a common frustum floor plane are shaped, said frustum large floors lying on the waveguide output plane, whereto on, defining a projected annulus area numerically equated to the rectangular waveguide output area, and defining at that plane the heights of the internal body and the shell, whereas two symmetrical pairs of side wall forming vertical surfaces, each pair positioned on one side of the axial vertical plane of symmetry, and the two vertical surfaces from each pair tangential to the frustum shell small floors and forming one symmetrical half of the rectangular output width on said waveguide output plane, thus cutting two pairs of conic sections from the frustums and each pair of said conic sections defining one symmetrical half of the second folding region and one symmetrical half of the third air channel passageway respectively, said third air channel passageway shaped between the two vertical surfaces from the second folding region up to the respective half of the waveguide output, whereas said air channel passageway is having its total horizontal width D equal to a predetermined part from its total height H at the output, which ratio H/D controls the output wave front curvature along the height of the waveguide output on said output plane.

2. The radial input wave guide of claim 1, having said total horizontal width D of its passageway substantially equal to one half of its total height H at the output, making their ratio H/D numerically equaling 2, ensuring individual partial wave fronts on the periphery of the first folding region to travel along substantially identical accumulated path lengths from the last two air channels up to the waveguide output, forming along the height of that output a common in-phase and planar wave front.

3. The radial input wave guide of claim 1, having said total horizontal width D of its passageway smaller than one half of its total height H at the output, making their ratio H/D numerically larger than 2, ensuring the individual partial wave fronts on the periphery of the first folding region to travel along different accumulated path lengths from the last two air channels up to the waveguide output, said accumulated path lengths being longer towards the vertical waveguide output extremes, gradually shortening towards the horizontal extremes, forming at the output a common in-phase wave front of convex curvature along the waveguide output height, which curvature depth to some extent increases proportionally to said H/D ratio.

4. The radial input wave guide of claim 1, having said total horizontal width D of its passageway larger than one half of its total height H at the output, making their ratio H/D numerically smaller than 2, ensuring individual partial wave fronts on the periphery of the first folding region to travel along different accumulated path lengths from the last two air channels up to the waveguide output, said accumulated path lengths being shorter towards the vertical waveguide output extremes, gradually lengthening towards the horizontal extremes, forming at the output a common in-phase wave front of concave curvature along the waveguide output height, which curvature depth to some extent increases proportionally to said H/D ratio, decreasing below 2.

5. The radial input wave guide of claim 1, having said total horizontal width D of its air channel passageway substantially twice as large as the total axial length of said air channel passageway.

6. The radial input waveguide of claim 1, further including a substantially conical antireflective insert axially disposed contiguously with its larger floor to the internal body input wall face and extending generally to the circular output face of the respective counterpart compression driver, said insert having its floor diameter substantially equal to the waveguide radial input diameter, whereas said waveguide cylindrical circular input diameter and input area substantially equal the compression driver output diameter and output area respectively, although said inserts might be an integral part of the internal body.

7. The radial input waveguide of claim 1, further including a substantially frustum conical axial insert whose larger base is co-planar and fixed to the internal body input wall face of said internal body and extends to an annular output compression driver output face, where said insert smaller base circle fits the smaller output diameter of said annular output compression driver, and the larger compression driver diameter fits the waveguide cylindrical circular input diameter of said radial input of said radial input waveguide.

8. The radial input waveguide of claim 1, having at least one air passageway axial cross-sectional area in the vicinity of said first folding region with a substantially annular shape.

9. The radial input waveguide of claim 1, having said side wall forming surfaces of a general shape of vertical planes.

10. The waveguide of claim 1, having said side wall forming surfaces of a general shape of slightly convex arcuate cones.

11. The radial input waveguide of claim 1, having said side wall forming surfaces of a general shape of slightly concave arcuate cones.

12. The radial input waveguide of claim 1, further including a plurality of thin wave guiding vanes, disposed contiguously between internal body side vertical walls and said shell side vertical walls, said wave guiding vanes forming a plurality of individual air channel passageways starting at the second folding region, and extending to the waveguide output plane, dividing its individual input and output normal to the wave traveling path areas in such a way as each one to carry substantially proportional energy to its proportion of individual output area from the total output area, and all air channels having substantially identical expansion rates.

13. The radial input waveguide of claim 12, having said thin wave guiding vanes further extending inwards in generally cone generatrix direction, from said second folding region up to said first folding region, disposed contiguously between the two substantially conical frustum and generally non-parallel said top/bottom walls of the internal body and the shell.

14. The radial input waveguide of claim 13, having said wave guiding vanes further extended inwards in generally radial direction from said first folding region to the waveguide input, dividing the first air channel into individual substantially radial sound wave passageways, each one keeping expansion rates identical to its own respective predecessor from the last two air channel passageways.

15. The radial input waveguide of claim 12, further having its wave guiding vanes, together with the shell wall periphery at the output, outwards extruded at a predetermined distance normal to the waveguide output wave front.

16. The radial input waveguide of claim 12, further having a thin vertical guiding vane into said vertical plane of symmetry extended between the normal and extruded output planes, and connecting the waveguide's vertical output shell extremes.

17. A system of two radial input waveguides of claim 1, horizontally stacked together side by side spreading horizontally in an angular fashion, both sharing a common input area of a high frequency line array element, said common input area being generally equal to the sum of the output areas of the two waveguides.

18. A system of three radial input waveguides of claim 1, horizontally stacked together side by side spreading horizontally in an angular fashion, all three waveguides sharing a common input area of a high frequency line array element, said common input area generally equal to the sum of the output areas of the three waveguides.

* * * * *